United States Patent [19]

Norman

[11] 4,098,225

[45] Jul. 4, 1978

[54] ENVIRONMENTAL, SMALL-PART CONTINUOUS WASHING APPARATUS

[76] Inventor: Maurice Norman, c/o John W. Gaines, 140 Fairway Ln., Wheaton, Ill. 60187

[21] Appl. No.: 493,077

[22] Filed: Jul. 30, 1974

[51] Int. Cl.[2] ..... B05C 3/02; B05C 5/00; B05C 15/00

[52] U.S. Cl. ..... 118/64; 118/303; 118/304; 118/418; 118/610; 134/65; 134/104; 134/108

[58] Field of Search ..... 118/418, 64, 303, 602, 118/19, 610, 58, 304, 61; 134/65, 132, 104, 105, 108; 34/134; 68/20; 427/242, 425

[56] References Cited

U.S. PATENT DOCUMENTS

| | | | |
|---|---|---|---|
| 901,455 | 10/1908 | Lauhoff | 118/303 X |
| 1,571,076 | 1/1926 | Warren | 34/134 X |
| 3,608,516 | 9/1971 | Temple | 118/19 X |
| 3,658,072 | 4/1972 | Santucci | 134/65 |
| 3,798,338 | 3/1974 | Galle | 118/418 X |

FOREIGN PATENT DOCUMENTS

| | | | |
|---|---|---|---|
| 1,020,552 | 12/1957 | Fed. Rep. of Germany | 118/303 |

*Primary Examiner*—John P. McIntosh

[57] ABSTRACT

Drum-type continuous washer for small parts in manufacture, e.g., fasteners. The parts, requiring oil and other soil removal, are tumble-washed therein, in steps in order: at an immersion station for tumbling the soaking parts in hot washing liquid; at a liquid-impingement station for loosening and spraying off the wetted soils by the force and cleaning action of impinged, hot sprays of continuously recycled washing liquid; at a drip-dry station for tumbling off excess liquid from within and without the individual tumbling parts, leaving them wet and hot; at a blow-dry station for rendering the hot parts damp by means of compressing and blowing-on hot, recycling-steamy atmosphere drawn from the process and preferably containing rust-inhibitor coating material; and at an evaporative dry (final dry) station for discharging the cleaned, hot, rust-proofed parts essentially moisture-free by flash drying.

14 Claims, 5 Drawing Figures

ENVIRONMENTAL, SMALL-PART CONTINUOUS WASHING APPARATUS

This application relates to a continuous washer for small parts in manufacture. It more particularly relates to a rotating drum washer of an internal helix type, having multiple stations which provide a stepped operation and which include at least a hot spray-rinse station and a hot blow-dry station for the parts, e.g., machine fasteners.

According to practice in the past, parts washing apparatus of either the drum type or pan washer type has employed at the appropriate stage a water rinse sprayed on the parts, the rinse water naturally becoming contaminated with the soaps from the preceding wash stations. Further, the rinse cycle in some cases was accomplished with rush inhibitor added, the run-off rust inhibitor in the water naturally becoming contaminated like the rinse water itself. Also, some apparatus in the past has employed at the appropriate stage a hot jet of compressed air blown onto the steamy parts, the air needing to be extremely pre-heated to insure hot air-bathing of hot parts for blowing them dry.

The problem has been the lack of an effective closed system for everything, operating compactly and functioning with efficient recycling, thus conserving energy and others of our resources, and minimizing pollution. It can be seen as definite drawbacks that past practices utilized un-reusable rinse water or rinse water and inhibitor, with consequent high wastage and with a large volume of polluted water discharged. Compressing and pre-heating of the blown-on air consumed substantial amounts of unrecoverable heat energy, and blowing such compressed air onto steaming parts and out into a plant area tended to steam-up the plant atmosphere, causing local pollution from the resulting cloud of hot-moist air.

My invention herein of a compact, recycling type, automatic washer substantially reduces if not largely eliminates the foregoing problem and drawbacks connected with the wash-and-dry of small manufactured parts, as will now be explained in detail. Various features, objects, and advantages will either be particularly pointed out or become apparent when, for a better understanding of the invention, reference is made to the following description, taken in conjunction with the accompanying drawings which show certain preferred embodiments thereof and in which.

Figure 1:
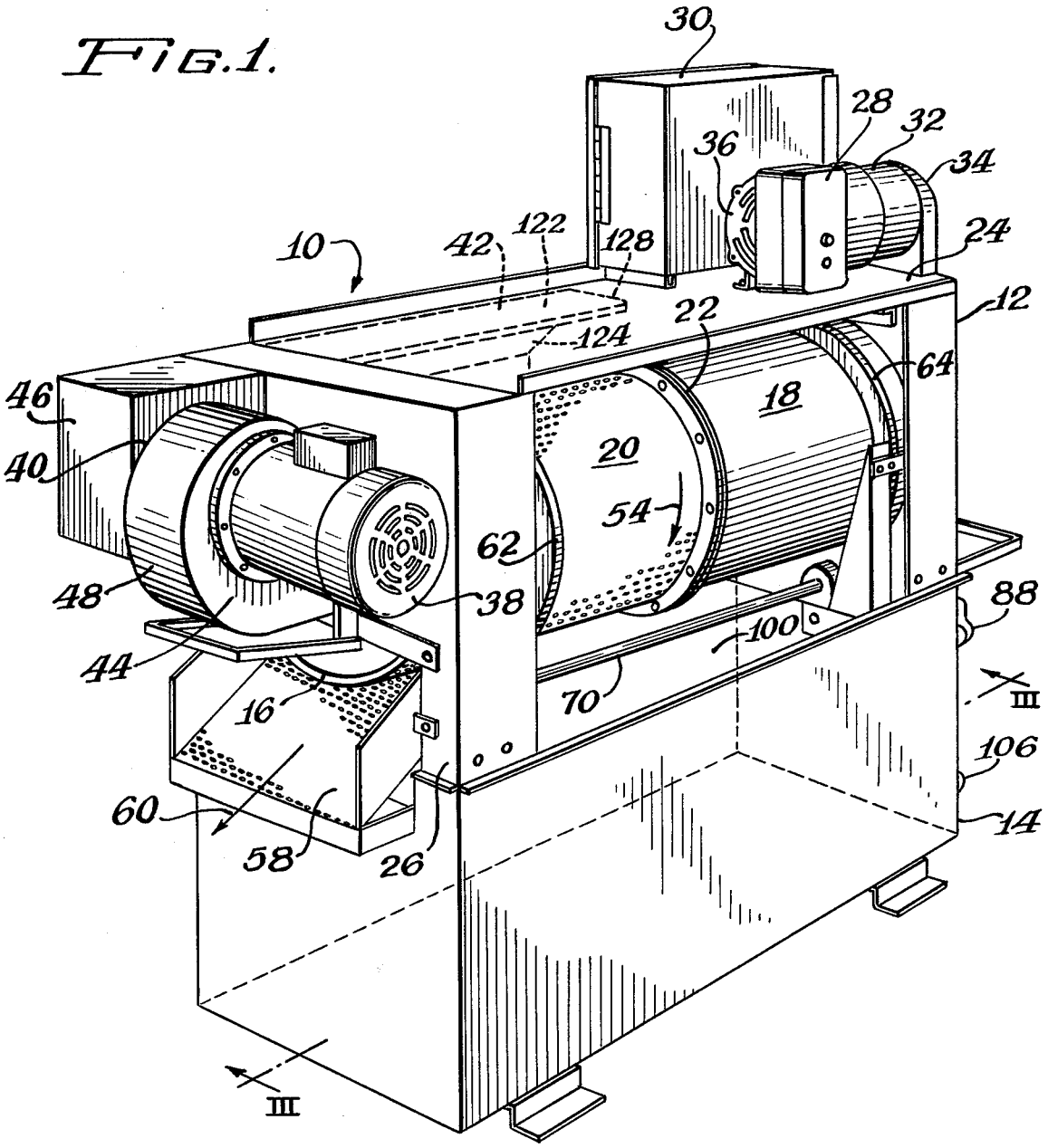
FIG. 1 is a perspective three-quarters view showing the discharge end of a continuous washer embodying my invention, one side-plate of the cabinet housing being removed to expose the washer drum in the top of the washer.

More particularly in FIG. 1 of the drawings, a continuous washer 10 is shown comprising respectively, from top-to-bottom, a drum section 12 and a tank section 14.

The tank section 14 forms a reservoir for holding washing liquid in the washer.

A parts-tumbling drum 16 is supported in the drum section 12 for rotation about its fixed longitudinal axis, and the axis, not shown, and the drum 16 are set in the washer to have a slight angle of inclination to a horizontal plane. The drum 16 thus inclines upwardly from the lower, outer end of an imperforate or solid-walled drum end section 18 to the upper, outer end of a perforated wall, drum end section 20. An out-turned pair of registering radial flanges 22 carried by the drum sections is bolted together at a point generally adjacent the middle of the drum so as to secure the respective sections 18 and 20 unitarily together.

The top 24 of a cabinet forming the housing 26 of the washer carries a run-switch box 28 for operating washer motors, a control box 30 for certain electrical controls, and a drum chain drive 32. A chain guard 34 houses a sprocket chain therein, not shown, and an electric motor 36 in the chain drive 32 carries a sprocket pinion, not shown, meshing with the sprocket chain. The chain drive 32 unidirectionally rotates the drum 16 at a slow uniform rate by means of a connection with a drum sprocket wheel, not shown.

When all parts of the washer cabinet are installed so as to complete the integrity of the housing 26 with a proper fit, the motor 36 is set to running to turn the drum 16 and, at the same time, an electric motor 38 to power a compression section 40 is set to running. The compression section 40 has an upper, laterally offset duct 42 forming an inlet extending adjacent and generally parallel to the perforated section 20 of the drum, and the duct 42 draws off from inside the washer the moisture-laden atmosphere therein surrounding the perforated section 20. A lower, central duct 44 forming an outlet for the compression section discharges the moisture-laden air under pressure back into the perforated section 20 of the drum. A generally rectangular plenum chamber 46 in the compression section has a scroll 48 in communication therewith, and the scroll contains a multi-bladed air rotor of the squirrel cage type, not shown, which is rotatably supported therein by the electric motor 38 in the compression section 40.

Figure 2:
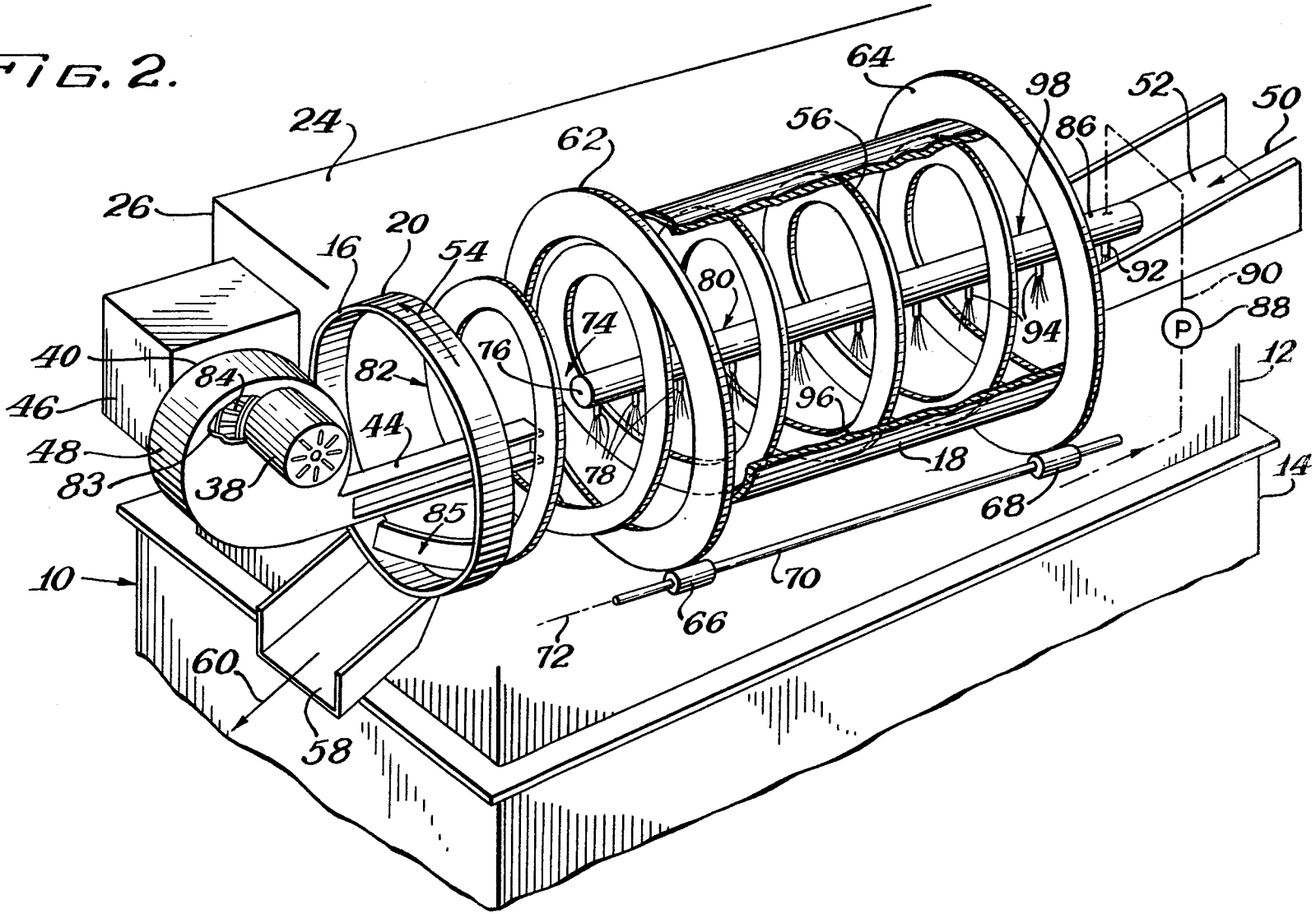
FIG. 2 is an isometric view similar to FIG. 1, but with parts of the drum and more parts of the cabinet removed to expose the drum mechanism.

In FIG. 2, the direction of material flow is indicated by arrows, the parts entering the washer 10 as shown by an arrow 50 in a direction down a charging chute 52 which is in the mouth of a central opening at the lower, outer end of the imperforate drum end section 18. A counterclockwise direction of drum rotation as indicated by an arrow 54 enables a curving inside fence or flange forming an internal helix 56 to move the parts horizontally and upwardly through the drum 16. Registering with and below the outer, upper open end of the perforated drum end section 20 is a discharge chute 58 along which discharging parts, following washing, slide in the direction of an arrow 60 into the appropriate next piece of processing apparatus or feeder or container as provided.

Longitudinally spaced apart along the drum 16 are the drum's two large diameter rings or metal tires 62 and 64. The tires ride on two sets of supporting rollers disposed beneath the drum, each set of rollers such as the illustrated rollers 66 and 68 being on the opposite side of the vertical midplane of the drum from the other roller set. Each roller set has a slightly inclined, stationary shaft, as exemplified by the shaft 70, which supports the rollers 66 and 68 on a fixed axis 72 each for rotation in the fixed plane of its associated drum tire.

Located generally within the mid-portion of the perforated drum section 20, the drum 16 is divided so as to define an intervening drip-dry (wet) station 74 for the washed, dripping parts passing through. Anteriorly next thereto and downhill within the perforated section 20, a longitudinal spray manifold 76 carries a set of spray station nozzles 78 for impinging hot washing liquid on the parts at a spray station 80 prior to their drip-drying. Posteriorly next to drip-dry station 74 and uphill thereof, the longitudinal outlet duct 44 of the compression section 40 establishes a hot, blow-dry (damp) station 82 in the perforated drum section 20 prior to the parts being flash-dried. In the compression section scroll 48 where it is broken away, the annular row of radial blades of a squirrel cage centrifugal blower 83 is indicated at 84.

Finally, the outer end of the perforated section 20 and the discharge chute 58 establish an evaporative (final dry) station 85. At station 85, the washer 10 tumbles out the hot washed parts which, at the time, are flashing-dry so as to be rendered essentially moisture free at the point where later parts tumble out and onto them.

The spray manifold 76, which has an outer end 86 projecting beyond the corresponding outer end of the drum 16, is supplied with washing liquid by a constantly running electric pump 88 having its output connected to the projecting outer end 86 of the manifold. The pump 88 is included in a spray line 90 which draws from the reservoir of washing liquid in the tank section 14.

The manifold 76, which extends coextensively with the drum 16 for a majority of the length of the latter and is generally concentric therewith, has one or more wash nozzles 92 adjacent the outer end 86 which impinge down on the washer charging chute 52 to keep it free from soil sticking thereto. Also, between the spray and wash-down nozzles 78 and 92, respectively, the manifold 76 can be provided with an intervening row of nozzles 94 for continuous replenishment and agitation of a pool area 96 for washing liquid maintained at an immersion station 98 in the lower parts of the imperforate drum section 18.

Figure 3:
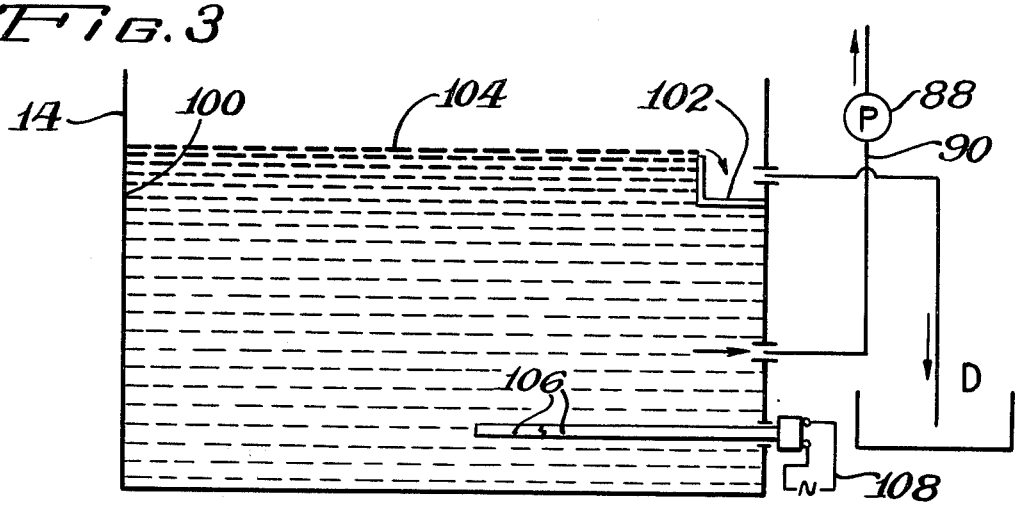
FIG. 3 is a sectional view in side elevation taken along the section line III—III in FIG. 1 to expose the reservoir tank in the bottom of the washer.

In FIG. 3, the tank section 14 of the washer 10 defines an upwardly open tank 100 subject to constant recycling of its washing liquid by circulation due to the spray line 90 and by action of a skimmer trough 102 at the top of the tank. A froth composed of washing material, oil, and other soils, and liquid is constantly forming, rising, and floating longitudinally across the surface of the body of washing liquid 104. The transversely disposed trough 102, which extends for the full width of the tank 100, acts to retain the liquid generally from over-running and skims off the froth or foam which is continually spilling over and running to drain D for flushing as waste.

A side-by-side series of longitudinally extending heating elements or a single such resistance-heating element 106 as necessary is fitted in the bottom of the tank 100 so as to heat the body 104 of the liquid when immersed. Each of the elements 106 shares an adjustable, common electric source 108 thermostatically controlled to regulate the temperature of the elements to ±5° F, for instance.

Figure 4:
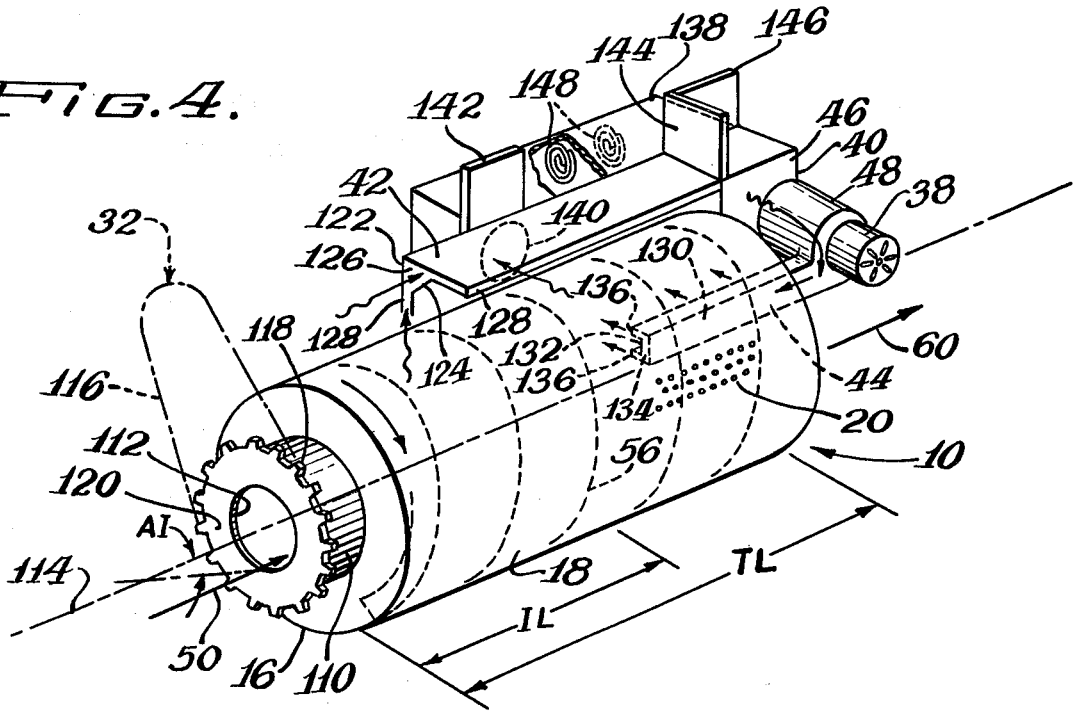
FIG. 4 is an isometric view somewhat similar to FIG. 2, but showing a modification of the invention.

The modification as shown according to FIG. 4 has some exceptions as explicitly noted but, otherwise, is the same as the preceding embodiment of the washer. Similarly, the drum 16 is divided into an imperforate section 18, the imperforate length IL of which is about half the total length TL of the drum 16. The drum 16 is continuously charged at the necked-down outer end portion 110 of the imperforate section 18 through a central opening 112, and the opening 112 and drum 16 have a coaxis 114 about which they are rotated by the chain drive 32. The upward tilt of their coaxis 114 is indicated by the angle of inclination AI. A drive chain 116 within the chain guard of the drive 32 as earlier described is trained over a drum sprocket 118 carried by an end disk 120 which defines the opening 112. The disk 120 is affixed to, and transmits the drive torque into the drum through, the reduced-diameter cylindrical part of the necked-down portion 110.

Similarly, the upper, laterally offset inlet duct 42 of the compression section 40 draws from the hot, moist atmosphere surrounding the perforated drum section 20 and, for that purpose, is formed of an outer angle plate 122 of L-shape and a coextensive, closely spaced apart inner plate 124 of U-shape. The L-angle 122 and U-plate 124 have maximum separation at their center sections to define a longitudinally extending air passage open at the outer end 126 and at the opposite end. The corresponding legs or flanges carried by the L-angle and U-plate 122,124 at their center sections define two suction slots 128 which are mutually perpendicular to one another and which extend for the length of the inlet duct 42.

Similarly, the lower central outlet duct 44 performs the blow-dry function and, for that purpose, is formed of outer and inner U-plates 130,132 which are complementary to one another and closely spaced apart. As can be imagined from their general cross section profiles consistent with a plate 134 permanently blanking off their ends, the U-plates 130,132 have maximum separation at their center sections to define a longitudinally extending air passage closed at the end carrying the plate 134 and open at the opposite end. The corresponding legs or flanges carried by the U-plates 130,132 at their center sections define two blow-slots 136 essentially parallel to one another. Each of the slots 136 extends for the length of the outlet duct 44 and is in a plane angled at about 45° to the horizontal. The drum 16 rotates its internal helix 56 in a direction such that the parts engaged thereby are rotated toward and climb partway up the inner wall of the drum on that side of the drum in the direct path of the blown-on air from the blow-slots 136; high pressure of the two air streams on the tumbling parts causes the parts to be blown free of excess liquid and to have liquid which is trapped in recesses thereof to be dislodged.

None of the parts primarily contemplated herein for washing and drying could be said to be immense in size, and their main characteristic is the continuous multitude which must be steadily handled and be kept separated and moving along. Many are already threaded when ready to be cleaned off, such as wood screws, socket screws, socket head cap screws, machine screws, cap screws, and threaded nuts. Others, which either do not require threading at all or are to be threaded later, include rivets, headed blanks, nut blanks, preforms, and extrusions.

The soils to be cleaned off the parts naturally vary according to what particular manufacturing operations precede the cleaning and what the local conditions of the manufacturing plant are. The soils very often include an oil coat on the surface residual from the cutting oil used on parts with cut threads. Depending upon the stock from which the parts have been made, the soils dirtying the parts can include wire coatings still present such as phosphates and the so-called molycoat molybdenum compounds. Parts which are threaded by roll threading operations and parts which are threaded by impact operations carry other, oftentimes very tenacious, coats as soil thereon, e.g., the sulfurated high viscosity oils used as impact lubricants.

The foregoing dirty, not-so-immense parts which are so readily handled in compact washers according to my invention have a main category which for convenience can be termed the medium size tumbled parts. There are other categories which, only by way of intending description and not limitation, can be relatively termed the small size tumbled category and the large size tumbled category.

MEDIUM

Most parts washed fall into this particular size-category. The heat stored in the mass of metal of each part after being blown-dry (damp) in its heated environment is sufficient, thereafter, to evaporate or flash-dry residual dampness off the part as it tumbles down so as to be essentially free of moisture. In being formed in a pile upon leaving the discharge chute 58, the parts being piled upon introduce practically no wetness down in the pile.

SMALL

Examples of parts in this size-category are tiny rivets, screws, and so forth. FIG. 4 illustrates an optional attachment for the washer to raise temperature of the heated invironment which the washer affords to small tumbled parts. Hotter temperature compensates for lack of mass in each part and lesser ability to retain heat for finishing drying itself off, as compared to each medium size part as described.

In FIG. 4, the option of a calrod-heated side duct 138 is shown added to the compression section 40; appropriate side openings such as opening 140 and vertically slidable gates 142,144,146 are provided as schematically illustrated, or else baffles and valved air holes, not shown, are provided as desired. With only the gate 144 set open, the inlet duct 42 will obviously bypass the side duct 138 so that the latter will have no effect.

However if the gates 142 and 146 are the only gates open, the steamy atmosphere inducted by the duct 42 will be diverted into the length of the side duct 138 and across a series of transversely disposed electric-range-like resistance heating elements 148 of the calrod type which are equally spaced apart along the inside of the side duct. The "wet" air by its short exposure to intense heat will undergo a sharp if not instantaneous increase in temperature as it flows through. Then in its hotter state, the air will be immediately returned to inside the perforated drum section 20 via registering openings (not shown) in the side duct 138 and juxtaposed wall of the plenum chamber 46, the plenum chamber 46, the scroll 48, the squirrel cage blower rotor 83, and the central outlet duct 44.

The metal in the small size tumbling parts, due to their exposure to the high temperature air being blown at the blow-dry station 82, thus will all reach an additionally elevated temperature just upon coming to the evaporative or final dry station; thereafter before losing all of the heat stored in the metal, the parts will have flash-dried at the surface in the desired way. Intermediately adjusted settings of the gates will produce partial bypassing of the diverted air, resulting in intermediate elevated temperatures of parts discharged.

LARGE

Figure 5:
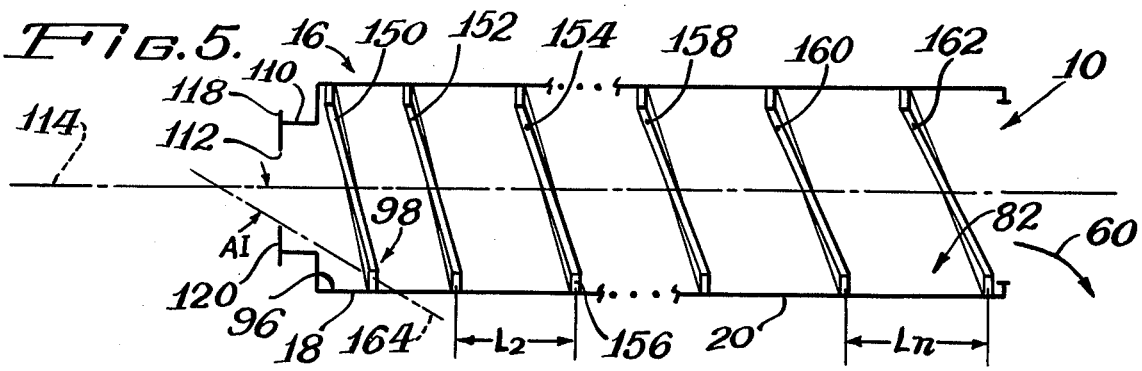
FIG. 5 is somewhat similar to FIG. 2, but being a sectionalized showing in side elevation of another modification.

In FIG. 5, the drum 16 shown has a modified form of internal helix 156 adapted to move large-size tumbled parts through the washer 10 with greater facility. The helix is continuous and the consecutive full turns thereof are indicated in the order 150,152,154,158,160, and 162. Beginning in the imperforate section 18 where they start adjacent the charging end of the drum 16, the helix turns progressively increase in pitch or lead measurement right on through to the *n*th turn at the discharge end of the drum. Thus, compared to the first, or shortest pitch turn 150, the second turn 152 has a longer lead $L_2$; finally, the *n*th turn 162 at the end of the helix has the longest lead $L_n$. So mathematically it is not a true helix.

Otherwise, it is sometimes found with uniform pitch helices that the large parts agglomerate or jam during progress through the drum and are incompletely washed and dried when discharged.

Rotating on an axis 114 having the angle of inclination AI as shown in FIG. 5, the drum 16 can be seen from its geometry in relation to the central charging opening 112 to trap and continuously maintain therein an immersion pool of washing liquid which, as measured from its surface 164, will always have predetermined depth to it for giving the parts an assured start at soaking down in the liquid.

LIQUID

The cleaning medium in the washer 10 referred to as washing liquid is sometimes referred to variously hereinafter, and in the claims also, as water-base washing material and wash water.

No limitation on the composition is intended either within the meaning of this application or on the user of the washer, because many solvents besides water work in the washer with equal effectiveness. And the medium does not have to have the composition of a solution at all. Simply, familiar terms have been used herein for convenience and ease of understanding the washer.

So broadly, a washing material is applied by the washer in a suitable liquid carrier or vehicle. Among the additives included, rust inhibitor is a highly preferable one if not an essential one.

The so-called solvents are therefore not to be ruled out as the medium of the composition even though they presently pose a disposal and pollution problem; nor are detergents to be ruled out of the composition as the washing material therein, although many of the popular detergents have now been criticized as raising a disposal and pollution problem.

Some colloidal concentrates in water make an effective water-base washing material without ecological drawbacks to them, and such concentrates include oakite surfactant and other suitable surfactants which have been found highly satisfactory.

Among the rust inhibitors that I find highly satisfactory are inhibitors which are primarily silicates. They are, in form, colloidal size particles, and it is believed they do not dissolve in the washing material but remain in solid state. In any event the inhibitor solids, if solids they be, are nevertheless driven off in the water vapor in the case of a hot water-base washing material as described, when it is maintained in the washer in a temperature range which is approximately between 180° and 200° F.

EXAMPLES

Following are examples of physical and other characteristics of typical washers, given for illustrative purposes only and not by way of limiting the invention.

| DRUM 16 | | TANK 100 |
|---|---|---|
| Length (TL) | 48" | 65 gal. capy. Also 220 gal. capy. |
| OD (metal tires) | 16" | Heat electrically maintained |
| ID | 14" | within ± 5° F at some point |
| ID cent. opng. 112 | 12" | in range approx. 180°-200° F |
| (preferred, but up to about | | COMPRESSION |
| 80% of drum OD satisfactory) | | Rotor OD 8" |
| | | (blower 83) |
| Speed of rotation 2 rpm | | Speed 3,450 rpm |
| Transit time each part 1'20" | | Expanded Helix 156 L1 4" |
| Prod. capy. sized for 150 | | L2 4½" L3 5" L4 5½" L5 6" |
| lb./hr. Also 500 and 1,000. | | L6 6½" L7 7" L8 7½" |
| Imperf. ratio IL/TL 45%-80% | | SIDE DUCT 138 |
| Floated soils skim, Cont. 20 gal./hr. | | Calrod heaters |
| Tank contents changed only with | | 500°-1,000° F |
| periodic necessary maintenance. | | 750° F preferred. |
| Upward incl. angle AI 3 - 30° | | DIA. DRUM PERFOR. |
| AI preferred 5 - 10° | | 1/8" - 1/2" |
| Drum perforation example 1/8" on 3/16" centers (40% open) | | |
| Openness of perforated section 40% - 50% preferred. | | |
| Large size tumbled part example 2" × 2" size, nom. | | |
| Depth pool maintained below surface 164 2" - 4". | | |

OPERATION

In the drawings, the parts entering the washer 10 down the charging chute 52 are in many instances hot from an immediately preceding forming, threading, or other operation. In general, at the immersion station 98 they are submerged and soaked while tumbling in the pool of liquid trapped by end disk 120 in the perforate section; all areas including blind holes and recesses in the parts are thoroughly soaked. At spray station 80, hot liquid spraying onto the parts dislodges all soaked dirt, oils, and chips; continuous tumbling exposes each part to liquid impinging on all areas several hundred separate times. The surface active character of the recommended washing material allows the liquid to work around edges and corners and reach hard-to-get-at places. At the drip-dry station 74, liquid drains from the tumbling parts assuring that all excess liquid vacates the recesses and blind holes. High pressure air at the blow-dry station 82 removes further liquid, such as trapped liquid dislodged thereby from difficultly-reached recesses. Then, in about a 180° F residual temperature state of the parts, each of the parts travels away from the final-dry station 85 as a dry part.

Novelty is felt to reside in the particular way here of soaking the parts. Cooperation is established between the proportionally long imperforate section 20 and drum end disk 120 having the reduced diameter opening 112, and also by means of the resulting constant pool in area 96 having immersion surface 164, and between the pumping helix 56 displacing the liquid axially out of the pool and the intervening nozzles 94 continuously replenishing and freshening the pool to keep the pool surface 164 at the constant level desired.

Novelty is also felt to reside in the compression section 40, which provides in my process a blower-dry-distillate-rinse-coat step at the blow-dry station 82. The reason lies in the character of the steam passing out the perforated section 20 and into the inlet duct 42. At the spray temperatures involved at spray station 80, the steam carries off with it quantities of the inhibitor; so the composition being drawn through duct 42 into the compression section comprises an inhibitor present in a distillate of water, all carried in the stream of inducted air. Pressurization of the air in the compression section 40 causes the distillate with its inhibitor to condense at least partially and so the hot air being blown by the outlet duct 44 entrains a condensate with inhibitor present, very useful not only as agent for a good water rinse but also as agent for effective rustproofing.

The rinse water suspended in the hot air stream is believed to exist in very small droplets, and to good advantage. It is also believed the rinse water is moving very fast with the stream of air, and just bounces off without any free water to speak of being left on the surface of the parts; at the most, the parts are just damp with a very thin film of dampness and inhibitor on the metal surfaces, and the force of the hot air stream eliminates droplets in unprotected places as well as deep in complicated areas such as threads, recesses, and holes.

Then, later upon flashing dry, the parts retain on the metal a rust inhibitor coat which is fairly well proportionate to concentration of the inhibitor present in the distillate-condensate rinse water.

RECYCLING AND MINIMUM POLLUTION

The recycling effectiveness of the tank 100 in FIG. 3 is believed evident, from the continual floating off of oils and so forth as the means of keeping the water-base washing material clean and strong; make-up liquid is added from time to time as necessary, of course. And the skimmed off waste is relatively minor in volume compared to full tank capacity. Heavier waste such as chips gradually collects in a layer settling in the bottom of the reservoir tank 100.

The hot air is not wasted, but is continually recycled by the compression section 40 without appreciable heat loss or air loss to the closed cycle processes.

The condensate formed from the water distillate is immediately recovered after use as a high velocity rinse, and for being recycled simply passes through the drum perforations back into the upwardly open tank 100.

The rust inhibitor which misses the parts being blown-dry (damp) follows the same path described in the immediately preceding paragraph and, along with the condensate, rejoins the contents 104 of the reservoir tank 100 for re-use. The significance of the foregoing is I provide an effectively closed loop, atmospheric-pressure system.

So minimum pollution results from the rust inhibitor, and the local atmosphere suffers only minimal pollution from the minor quantities of hot air and steam escaping from the washer. An outside source of steadily flowing rinse water or of compressed air and an air heater therefor are not only unnecessary but undesirable in practicing my processes.

Although appearing in their more visible form as nozzles at 78, 92, and 94 for the illustrative purposes of FIG. 2, for their more preferable form in actual practice I simply provide graded size holes 78, 92, and 94 through the bottom side of the longitudinal manifold 76. Larger holes provided for example at 94 desirably introduce tumbling liquid whereas smaller holes at 78 introduce spraying liquid at the spray station 80.

Variations within the spirit and scope of the invention described are equally comprehended by the foregoing description.

What is claimed is:

1. For use in processing parts in manufacture, continuous hot-spray-process washing apparatus effective to hold therein a water-base washing material employed, and including a rust inhibitor for coating the washed parts, said rust inhibitor having the characteristic when elevated in temperature to be effectively drawn off with the steaming vapor arising from hot spraying, said apparatus comprising:

an elongated, generally horizontal, hollow drum respectively imperforate and perforated at opposite ends; said drum having means supporting it for rotation about a slightly tilted axis, so as to be correspondingly inclined to the horizontal and with the perforations at the relatively upper end and being imperforate at the lower end;

means for admitting parts into the drum at the imperforate end and discharging them from the perforated end; said drum having tumbling means connected to rotate therewith for moving tumbled parts from their admission, through at least an intervening drip-dry (wet) station in the drum and thence through discharge from the perforated end of the drum;

mutually opposing, first and second substantially aligned means both adjacent and on opposite sides of said intervening station in the drum, and each arranged in a generally central, longitudinal disposition within the drum, with said first means comprising wash-down manifold structure with portions located as aforesaid in the imperforate drum end at a respective immersion station and spray station, and said second means comprising duct structure located as aforesaid in the perforated end at a rinse-coat (damp) station;

said first means having heating and recirculating liquid supply means connected to the wash-down manifold structure, and having liquid impinging opening means in the manifold structure at the respective immersion and spray stations for pressure impingement of hot wash liquid on the parts at those stations consecutively;

said second means having compression and recirculating supply means connected to the duct structure, and having blow opening means in the duct structure at the rinse-coat (damp) station so as to blow on the parts with a part-rinsing rinse applied thereby over same and with a part-coating inhibitor coat applied thereby over same;

enclosing means substantially enclosing the apparatus; and a temperature control connected to said heating and recirculating liquid supply means to prevent the wash liquid from cooling below the effective draw-off temperature of the rust inhibitor therein.

2. The invention of claim 1, said enclosing means comprising:

a cabinet housing the drum and its supporting means and its wash-down manifold structure, to form thereabout an enclosure of substantially complete integrity, said second means having, connected to the compression and recirculating means thereof, generally longitudinally disposed inlet duct means within the cabinet, drawing wet air from the steaming atmosphere thereof and, following compression of the wet air in the compression and recirculating means so as to condense rinse distillate in the wet air, blowing back into the cabinet within the drum rinse-coat (damp) station described to rinse and coat (damp) as aforesaid.

3. The invention of claim 2, said heating and recirculating liquid supply means and its temperature control aforesaid comprising:

energizable heating elements and an energy source thermostatically controlled for maintaining the steaming water-base washing material adapted to be held by the apparatus within a predetermined elevated temperature range, whereby rust inhibitor goes off with the recycled water vapor and collects therewith as condensed distillate during compression so that, during rinse-coat (damp) with water-inhibitor distillate, rust inhibitor solids at the rinse-coat (damp) station when blown by the blow opening means are compression impinged onto the surface of the parts as an adherent coat.

4. The invention of claim 3, wherein said apparatus further comprises:

holding means for holding said washing material employed, said apparatus comprising respectively, from top-to-bottom, the drum constituting a drum section in said cabinet, and the holding means constituting the holding section in said cabinet and communicating inside the cabinet with the drum section.

5. The invention of claim 4, wherein the holding means is characterized by:

a tank with said energizable heating elements therein and disposed in said cabinet below the drum supporting means and the drum, and with the tank top in an upwardly open arrangement not only to effectively receive from the drum for recycle and re-use the water-base washing material indicated, but also to receive equally effectively the rinse condensate and inhibitor recovered from run-off water-inhibitor distillate.

6. For use in processing metal parts in manufacture, a continuous hot-spray-process, housed washer effective to utilize and recirculate hot wash liquid in the process, said washer comprising, from bottom-to-top, in that order:

a tank section in the washer housing for holding the hot wash liquid for recirculation, and being upwardly open for receiving both run-off hot rinse liquid and run-off hot wash liquid, and a drum section thereabove in the washer housing, with an elongated generally horizontal, hollow drum respectively imperforate and perforated at opposite ends; said drum having means in the drum section supporting it for rotation about a slightly tilted axis, so as to be correspondingly inclined to the horizontal and with the perforations at the relatively upper end and being imperforate at the lower end;

a cabinet forming said washer housing to enclose the tank section and the drum section thereabove so as to impart substantially complete integrity to the housing therefor;

means supported by the cabinet and supporting respective means for admitting the metal parts into the drum at the imperforate end and for discharging them from the perforated end; said drum having tumbling means connected to rotate therewith so that the tumbled parts are moved thereby from their admission, moved thereby through at least an intervening drip-dry (wet) station in the drum, and finally moved thereby through discharge from the perforated end of the drum; and means supported by the cabinet and supporting first and second substantially aligned means at opposite sides of said intervening station in the drum, and in a generally central position relative to the rotational axis of the drum, said first means comprising wash-down manifold structure with portions supported as aforesaid and within the cabinet in the imperforate drum end at a spray station, said second means comprising a compression section (40) supported as aforesaid and at the perforated end;

said first means having recirculating means (88) connected between the wash-down manifold structure and the tank of hot wash liquid, and having liquid impinging opening means in the manifold structure at the spray station for pressure impingement of hot wash liquid on the parts at that station;

said second means having with respect to said perforated drum end a relatively central, outlet duct structure at a rinse-dry (damp) station in the drum and communicatively connected to said compression section, and an upper, relatively laterally offset, inlet duct structure having independent communication with said compression section, the inlet and outlet having in the duct structures respectively suction opening means inside the cabinet adjacent the drum and blow opening means at the rinse-dry (damp) station in the drum so as to draw from the hot, wet air enclosed by the cabinet surrounding the perforated drum section and, following compression of the wet air and condensation of distillate therein, so as to blow on the metal parts with a part-rinsing distillate rinse applied thereby over same.

7. For use in processing metal parts in manufacture, a continuous hot-spray-process, housed washer effective to utilize and recirculate hot wash liquid in the process, said washer comprising, from bottom-to-top, in that order:

a tank section in the washer housing for holding the hot wash liquid for recirculation, and being upwardly open for receiving both run-off hot rinse liquid and run-off hot wash liquid, and a drum section thereabove in the washer housing, with an elongated generally horizontal, hollow drum respectively imperforate and perforated at opposite ends; said drum having means in the drum section supporting it for rotation about a slightly tilted axis, so as to be correspondingly inclined to the horizontal and with the perforations at the relatively upper end and being imperforate at the lower end;

a cabinet forming said washer housing to enclose the tank section and the drum section thereabove so as to impart substantially complete integrity to the housing therefor;

means supported by the cabinet and supporting respective means for admitting the metal parts into the drum at the imperforate end and for discharging them from the perforated end; said drum having tumbling means connected to rotate therewith so that the tumbled parts are moved thereby from their admission, moved thereby through at least an intervening drip-dry (wet) station in the drum, and finally moved thereby through discharge from the perforated end of the drum; and means supported by the cabinet and supporting first and second substantially aligned means at opposite sides of said intervening station in the drum, and in a generally central position relative to the rotational axis of the drum, said first means comprising wash-down manifold structure with portions supported as aforesaid and within the cabinet in the imperforate drum end at a spray station, said second means comprising a compression section (40) supported as aforesaid and at the perforated end;

said first means having recirculating means (88) connected between the wash-down manifold structure and the tank of hot wash liquid, and having liquid impinging opening means in the manifold structure at the spray station for pressure impingement of hot wash liquid on the parts at that station;

said second means having with respect to said perforated drum end a relatively central, outlet duct structure at a rinse-dry (damp) station in the drum and communicatively connected to said compression section, and an upper, relatively laterally offset, inlet duct structure having independent communication with said compression section, the inlet and outlet having in the duct structures respectively suction opening means inside the cabinet adjacent the drum and blow opening means at the rinse-dry (damp) station in the drum so as to draw from the hot, wet air enclosed by the cabinet surrounding the perforated drum section and, following compression of the wet air and condensation of distillate therein, so as to blow on the metal parts with a part-rinsing distillate rinse applied thereby over same;

the inlet and outlet duct structures having a longitudinal disposition, generally parallel to one another and to the drum.

8. The invention of claim 7, wherein:

the outlet duct structure leads, in order to blow on the metal parts, from the compression section through an entry orientation and location more or less axially of the drum through a generally central end opening in said perforated upper end thereof.

9. The invention of claim 7, wherein:

the inlet duct structure has heater means associated with its aforesaid independent communication with the compression section for adding extra heat and further elevating the temperature level at which to blow at the rinse-dry (damp) station in the way described.

10. For use in processing metal parts in manufacture, a continuous hot-spray-process, housed washer effective to utilize and recirculate hot wash liquid and hot rinse liquid in the process, said washer comprising, from bottom-to-top, in that order:

a tank section in the washer housing for holding the hot wash liquid for recirculation, and being upwardly open for receiving both run-off hot rinse liquid and run-off hot wash liquid, and a drum section thereabove in the washer housing, with an elongated, generally horizontal, hollow drum respectively imperforate and perforated at opposite ends; said drum having means in the drum section supporting it for rotation about a slightly tilted axis, so as to be correspondingly inclined to the horizontal and with the perforations at the relatively upper end and being imperforate at the lower end;

a cabinet forming said washer housing to enclose the tank section and the drum section thereabove so as to impart substantially complete integrity to the housing therefor;

means supported by the cabinet and supporting respective means for admitting the metal parts into the drum at the imperforate end and for discharging them from the perforated end; said drum having tumbling means substantially coextensive in length therewith and connected to rotate therewith so that the tumbled parts are moved thereby from their admission, moved thereby through at least an intervening drip-dry (wet) station in the drum, and finally moved thereby through discharge from the perforated end of the drum;

said tumbling means comprising hard strip means forming an inside helix in the drum, said helix progressively expanding from an effective small helix pitch to a large helix pitch from one end of the drum toward the other; and means supported by the cabinet and supporting first and second substantially aligned means at opposite sides of said intervening station in the drum, and in a generally central position relative to the rotational axis of the drum, said first means comprising wash-down manifold structure with portions supported as aforesaid and within the cabinet in the imperforate drum end at a spray station, said second means comprising a compression section (40) supported as aforesaid and at the perforated end;

said first means having recirculating means (88) connected between the wash-down manifold structure and the tank of hot wash liquid, and having liquid impinging opening means in the manifold structure at the spray station for pressure impingement of hot wash liquid on the parts at that station;

said second means having with respect to said perforated drum end a relatively central, outlet duct structure at a rinse-dry (damp) station in the drum and communicatively connected to said compression section, and an upper, relatively laterally offset, inlet duct structure having independent communication with said compression section, the inlet and outlet having in the duct structures respectively suction opening means within the cabinet adjacent the drum and blow opening means at the rinse-dry (damp) station in the drum so as to draw from the hot, wet air enclosed by the cabinet surrounding the perforated drum section and, following compression of the wet air and condensation of distillate therein, so as to blow on the metal parts with a part-rinsing distillate rinse applied thereby over same.

11. The invention of slaim 10, characterized by:

the drum and helix, in addition to being substantially coextensive in length as described, having substantially constant diameters throughout their length, and arranged with the small helix pitch in the lower end of the drum and the large helix pitch in the upper end of the drum.

12. For use in processing parts in manufacture, continuous hot-spray-process, housed washing apparatus effective to hold therein a water-base washing material employed which, when elevated in temperature, affords a steaming vapor arising from hot spraying which can be effectively drawn off in the wet air, said apparatus comprising:

an elongated, generally horizontal, hollow drum respectively imperforate and perforated at opposite ends; said drum having means in the apparatus housing supporting it for rotation about a slightly tilted axis, so as to be correspondingly inclined to the horizontal and with the perforations at the relatively upper end and being imperforate at the lower end;

a cabinet forming said apparatus housing to enclose the drum so as to impart substantially complete integrity to the apparatus;

means supported by the cabinet and supporting respective means for admitting the parts into the drum at the imperforate end and for discharging them from the perforated end; said drum having strip means forming inside helix means in the drum for rotating therewith, causing the parts to be tumbled and moved thereby from their admission, moved thereby through at least an intervening drip-dry (wet) station in the drum, and finally moved thereby through discharge from the perforated end of the drum;

said drum and its inside helix means being substantially coextensive in length, and having substantially constant diameters throughout their length;

means supported by the cabinet and supporting first and second substantially aligned means at opposite sides of said intervening station in the drum, and in a generally central position relative to the rotational axis of said drum, said first means comprising wash-down manifold structure with opening portions supported as foresaid and within the cabinet in the imperforate drum end at a spray station, said second means comprising a compression section (40) supported as aforesaid and at the perforated end, for compression impingement onto the surfaces of the parts, of hot recycled air, and of steamed-off vapor entrained therein and recycled from air being recycled by the compression section from the drum, as a water-rinse distillate;

said compression section comprising air ducts (42, 44) carried thereby constructed, oriented, and located respectively for drawing off the drum atmosphere from a cabinet area outside of, and communicating with, drum perforations and, under blowing impingement pressure, for discharging back the atmosphere thereinto in areas within the drum; the air duct for discharging back leading to atmosphere discharge-back areas at a rinse-dry (damp) drum station through an entry orientation and location more or less generally axially of the drum through a generally central end opening in the perforated upper section end thereof; and a washing material heating and recirculating source in the bottom of the cabinet connected to the wash-down manifold structure opening portions at the spray station, and having a temperature control to maintain the wet air thereat in a pre-selected steaming temperature range whereby, following compression of the wet air and condensation of water-rinse distillate entrained therein, the air duct when discharging back as described blows on the parts at the rinse-dry (damp) drum station with said part-rinsing distillate water-rinse applied thereby to same, said washing material heating and recirculating source being upwardly open for receiving both run-off hot rinse and run-off hot washing material.

13. The invention of claim 12, characterized by:

said air ducts being longitudinally disposed, essentially parallel to one another and to the rotational axis of the drum.

14. The invention of claim 12, said washing material source characterized by:

a liquid heating tank supported by the washer in the cabinet in the aforesaid upwardly open relationship below the drum, and provided with a froth removing trough establishing cooperation with the top of the tank for recycling the hot washing material and continuing the re-use thereof.

* * * * *